US010597946B2

(12) United States Patent
Azar

(10) Patent No.: US 10,597,946 B2
(45) **Date of Patent: *Mar. 24, 2020**

(54) DRILL BITS WITH INTERNALLY TAPERED BLADE AND TRIMMING CUTTING ELEMENTS

(71) Applicant: Smith International, Inc., Houston, TX (US)

(72) Inventor: Michael G. Azar, The Woodlands, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/187,067

(22) Filed: Nov. 12, 2018

(65) Prior Publication Data

US 2019/0078388 A1 Mar. 14, 2019

Related U.S. Application Data

(63) Continuation of application No. 14/956,897, filed on Dec. 2, 2015, now Pat. No. 10,125,548.

(60) Provisional application No. 62/095,705, filed on Dec. 22, 2014.

(51) Int. Cl.

| | |
|---|---|
| ***E21B 10/02*** | (2006.01) |
| ***E21B 10/43*** | (2006.01) |
| ***E21B 25/10*** | (2006.01) |

(52) U.S. Cl.

CPC ..... *E21B 10/02* (2013.01); *E21B 10/43* (2013.01); *E21B 25/10* (2013.01)

(58) Field of Classification Search

CPC ..... E21B 10/02; E21B 10/23; E21B 25/10

See application file for complete search history.

(56) References Cited

U.S. PATENT DOCUMENTS

| | | | | |
|---|---|---|---|---|
| 5,407,022 | A | 4/1995 | Scott et al. | |
| 7,703,559 | B2 | 4/2010 | Shen et al. | |
| 10,125,548 | B2 * | 11/2018 | Azar | E21B 10/43 |
| 2008/0035380 | A1 | 2/2008 | Hall et al. | |
| 2010/0219001 | A1 | 9/2010 | Shen et al. | |
| 2011/0297454 | A1 | 12/2011 | Shen et al. | |
| 2012/0018225 | A1 | 1/2012 | Peter et al. | |
| 2012/0111637 | A1 | 5/2012 | Chen et al. | |
| 2012/0205163 | A1 | 8/2012 | Azar et al. | |

(Continued)

OTHER PUBLICATIONS

International Search Report and Written Opinion issued in International Patent Application No. PCT/US2015/063880, dated Mar. 18, 2016, 13 pages.

(Continued)

*Primary Examiner* — Giovanna C Wright
*Assistant Examiner* — Brandon M Duck

(57) ABSTRACT

A drill bit for obtaining core sample fragments from a subterranean formation includes a bit body having a bit centerline and a bit face, a plurality of blades extending radially along the bit face, including a coring blade, a plurality of cutting elements on the blades, and a non-planar insert embedded in the bit body proximate the bit centerline. One of the cutting elements is a first cutting element on the coring blade at a first radial position from the bit centerline, and at least a portion of the coring blade is radially outward from a most radially interior cutting part of the first cutting element.

18 Claims, 10 Drawing Sheets

(56) References Cited

U.S. PATENT DOCUMENTS

| | | | |
|---|---|---|---|
| 2012/0234610 | A1 | 9/2012 | Azar et al. |
| 2012/0273280 | A1 | 11/2012 | Zhang et al. |
| 2012/0273281 | A1 | 11/2012 | Burhan et al. |
| 2012/0325563 | A1 | 12/2012 | Scott et al. |
| 2013/0020134 | A1 | 1/2013 | Azar et al. |
| 2014/0262536 | A1 | 9/2014 | Azar et al. |
| 2014/0262545 | A1 | 9/2014 | Azar et al. |
| 2016/0177629 | A1 | 6/2016 | Azar |

OTHER PUBLICATIONS

International Preliminary Report on Patentability issued in International Patent Application No. PCT/US2015/063880, dated Jul. 6, 2017, 10 pages.

* cited by examiner

DRILL BITS WITH INTERNALLY TAPERED BLADE AND TRIMMING CUTTING ELEMENTS

CROSS REFERENCE TO RELATED APPLICATIONS

This application is a continuation of U.S. patent application Ser. No. 14/956,897, filed Dec. 2, 2015, which claims the benefit of and priority to U.S. Patent Application No. 62/095,705 filed on Dec. 22, 2014, the entireties of which are incorporated herein by this reference.

BACKGROUND

In drilling a borehole, such as for the recovery of hydrocarbons or for other applications, it is conventional practice to connect a drill bit on the lower end of an assembly of drill pipe sections that are connected end-to-end so as to form a drill string. The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of these and/or other cutting methods, thereby forming a borehole.

Many different types of drill bits have been developed and found useful in drilling such boreholes. Two common types of drill bits are roller cone bits and fixed cutter (or rotary drag) bits. Most fixed cutter bit designs include a plurality of blades angularly spaced about the bit face. The blades project radially outward from the bit body and form flow channels therebetween. In addition, cutting elements are typically grouped and mounted on several blades in radially extending rows. The configuration or layout of the cutting elements on the blades may vary.

The cutting elements on the blades of a fixed cutter bit are typically formed of extremely hard materials. In atypical fixed cutter bit, each cutting element includes an elongate and generally cylindrical tungsten carbide substrate that is received and secured in a pocket formed in the surface of one of the blades. The cutting elements typically include a hard cutting layer of polycrystalline diamond (PCD) or other superabrasive materials such as thermally stable diamond or polycrystalline cubic boron nitride. These cutting elements are designed to shear formations that range from soft to medium hard. For convenience, as used herein, reference to "PDC bit" or "PDC cutters" refers to a fixed cutter bit or cutting element employing a hard cutting layer of polycrystalline diamond or other superabrasive materials.

Without regard to the type of bit, the cost of drilling a borehole is proportional to the length of time it takes to drill the borehole to the desired depth and location. The drilling time is affected by the number of times the drill bit is changed in order to reach the targeted formation, as each time the bit is changed, the entire drill string, which may be miles long, is retrieved from the borehole section by section. Once the drill string has been retrieved and the new bit installed, the bit is lowered to the bottom of the borehole on the drill string, which again is constructed section by section. This process, known as a trip of the drill string, often requires considerable time, effort, and expense.

The length of time that a drill bit may be used before it is changed depends upon its rate of penetration (ROP), as well as its durability or ability to maintain a high or acceptable ROP. Specifically, ROP is the rate that a drill bit penetrates a given subterranean formation. Drill bit designs are modified to improve ROP in specific formations so as to reduce drilling time, and thus, cost.

Once a desired formation is reached in the borehole, a core sample of the formation may be extracted for analysis. A hollow coring bit is often employed to extract a core sample from the formation. Once the core sample has been transported from the borehole to the surface, the sample may be used to analyze and test, for example, permeability, porosity, composition, or other geological properties of the formation. Conventional coring methods require retrieval of the drill string from the borehole, replacement of the drill bit with a coring bit, and lowering of the coring bit into the borehole on the drill string in order to retrieve a core sample, which is then removed to the surface for analysis.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a drill bit that includes a bit body having a bit centerline and a bit face, a plurality of blades extending radially along the bit face including a coring blade, a plurality of cutting elements disposed on the blades, and a non-planar insert embedded in the bit body proximate to the bit centerline. One of the plurality of cutting elements may be a first cutting element on the coring blade at a first radial position from the bit centerline, and at least a portion of the coring blade may be radially outward from a most radially interior cutting part of the first cutting element.

In another aspect, embodiments disclosed herein relate to a drill bit for obtaining core sample fragments from a subterranean formation that includes a bit body having a bit centerline and a bit face, a plurality of blades extending radially along the bit face, at least one of the blades being a coring blade that has a radially interior surface, and a plurality of cutting elements disposed on the plurality of blades. At least one of the cutting elements may be a first cutting element located at the first radial position from the bit centerline, and at least one of the cutting elements may be a core trimming cutting element on the coring blade on the radially interior surface axially spaced from the first cutting element and at a greater radial distance from the bit centerline than the first radial position. A non-planar insert may be affixed to the bit body proximate the bit centerline In yet another aspect, embodiments of the present disclosure relate to a method of obtaining core sample fragments from a subterranean formation during directional drilling that includes coupling a drill bit to a steerable tool at a lower end of a drill string, rotating the drill string to engage and cut the formation, thereby creating a wellbore, tilting the drill bit via the steerable tool to drill the formation at a non-vertical direction, and using a coring feature of the drill bit to weaken the core sample fragment in order to cause the core sample fragment to break away from the formation after the core sample fragment reaches a length. The drill bit used in the method may include a bit body having a bit centerline and a bit face, a plurality of blades extending radially along the bit face, at least one of the plurality of blades being a coring blade having a continuously angled surface extending from the bit face to a first radial position from the bit centerline, a plurality of cutting elements on the plurality of blades, one of the plurality of cutting elements being a first cutting element on the coring blade at the first radial position from the bit centerline. The drill bit may also include a gage surface extending from the plurality of blades at the radially outermost region of the drill bit, each gage surface being angled toward the bit centerline. The drill bit may also include a conical insert embedded in the bit body at the bit centerline or between the bit centerline and the first radial position. The continuously angled surface may have an angle that is about the same as the angle of the angled gage surface.

Other aspects and advantages of the claimed subject matter will be apparent from the following description and the appended claims.

DETAILED DESCRIPTION

Embodiments of the present disclosure will be described below with reference to the figures. In one aspect, embodiments disclosed herein relate to use of coring blades in PDC fixed cutter drill bits. In particular, embodiments disclosed herein relate to drill bits having coring blades having an angled surface proximate the bit centerline and/or interior cutting elements having radial offset for extracting core samples during directional drilling. Directional, or non-vertical, drilling angles are achieved by connecting a steerable tool between the drill bit and a lower end of a drill string. Directional drilling may involve tilting the drill bit several degrees from vertical in order to reach a targeted drilling region. When directionally drilling with a drill bit (not a coring bit) that includes a coring blade to extract small core samples, the titling that occurs may cause premature extraction of a core sample due to induced forces on the core sample from the coring blade. Thus, embodiments of the present disclosure are directed to variations on the radially interior surface of coring blade(s) so as to allow for the directional drilling without negatively impacting the core sample being formed. Other embodiments disclosed herein relate to fixed cutter drill bits containing conical or other non-planar cutting elements, including the placement of such cutting elements on a bit and variations on the cutting elements that may be used to optimize core sampling.

Figure 1:
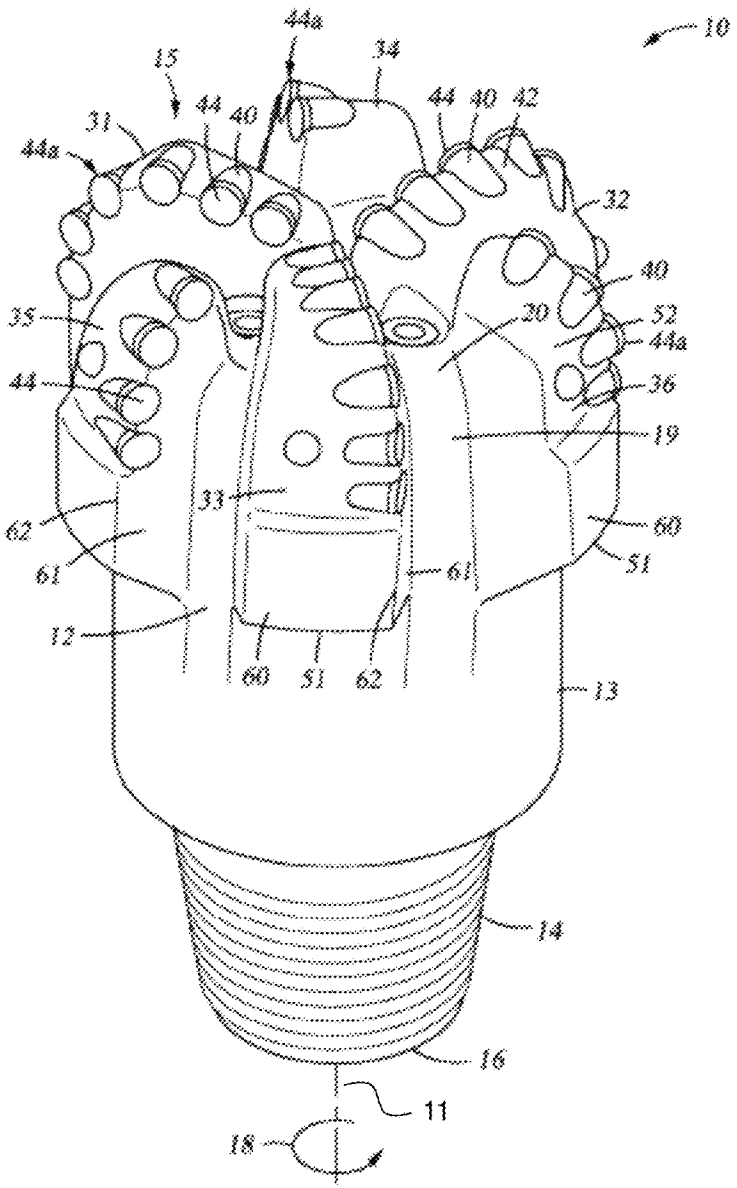
FIG. 1 is a perspective view of a PDC drill bit.

Referring to FIG. 1, a PDC bit 10 adapted for drilling through formations of rock to form a borehole is shown. The PDC bit 10 generally includes a bit body 12, a shank 13, and a threaded connection or pin 14 for connecting the PDC bit 10 to a drill string that is used to rotate the bit in order to drill the borehole. The bit face 20 supports a cutting structure 15 and is formed on the end of the PDC bit 10 that is opposite pin end 16. The PDC bit 10 further includes a central axis 11 about which PDC bit 10 rotates in the cutting direction represented by arrow 18.

The cutting structure 15 is on face 20 of PDC bit 10. The cutting structure 15 includes a plurality of angularly spaced-apart primary blades 31, 32, 33, and secondary blades 34, 35, 36, each of which extends from bit face 20. The primary blades 31, 32, 33 and the secondary blades 34, 35, 36 extend generally radially along the bit face 20 and then axially along a portion of the periphery of the PDC bit 10. The secondary blades 34, 35, 36 extend radially along the bit face 20 from a position that is distal the bit axis 11 toward the periphery of the PDC bit 10. Thus, as used herein, secondary blade may be used to refer to a blade that begins at some distance from the bit axis and extends generally radially along the bit face to the periphery of the bit. The primary blades 31, 32, 33 and the secondary blades 34, 35, 36 are separated by drilling fluid flow courses 19.

Each primary blade 31, 32, 33 includes blade tops 42 for mounting a plurality of cutting elements, and each secondary blade 34, 35, 36 includes blade tops 52 for mounting a plurality of cutting elements. In particular, cutting elements 40, each having a cutting face 44, are mounted in pockets formed in blade tops 42, 52 of each primary blade 31, 32, 33 and each secondary blade 34, 35, 36, respectively. Cutting elements 40 are arranged adjacent one another in a radially extending row proximal the leading edge of each primary blade 31, 32, 33 and each secondary blade 34, 35, 36. Each cutting face 44 has an outermost cutting tip **44*a* furthest from blade tops 42, 52 to which cutting element 40** is mounted.

Figure 2:
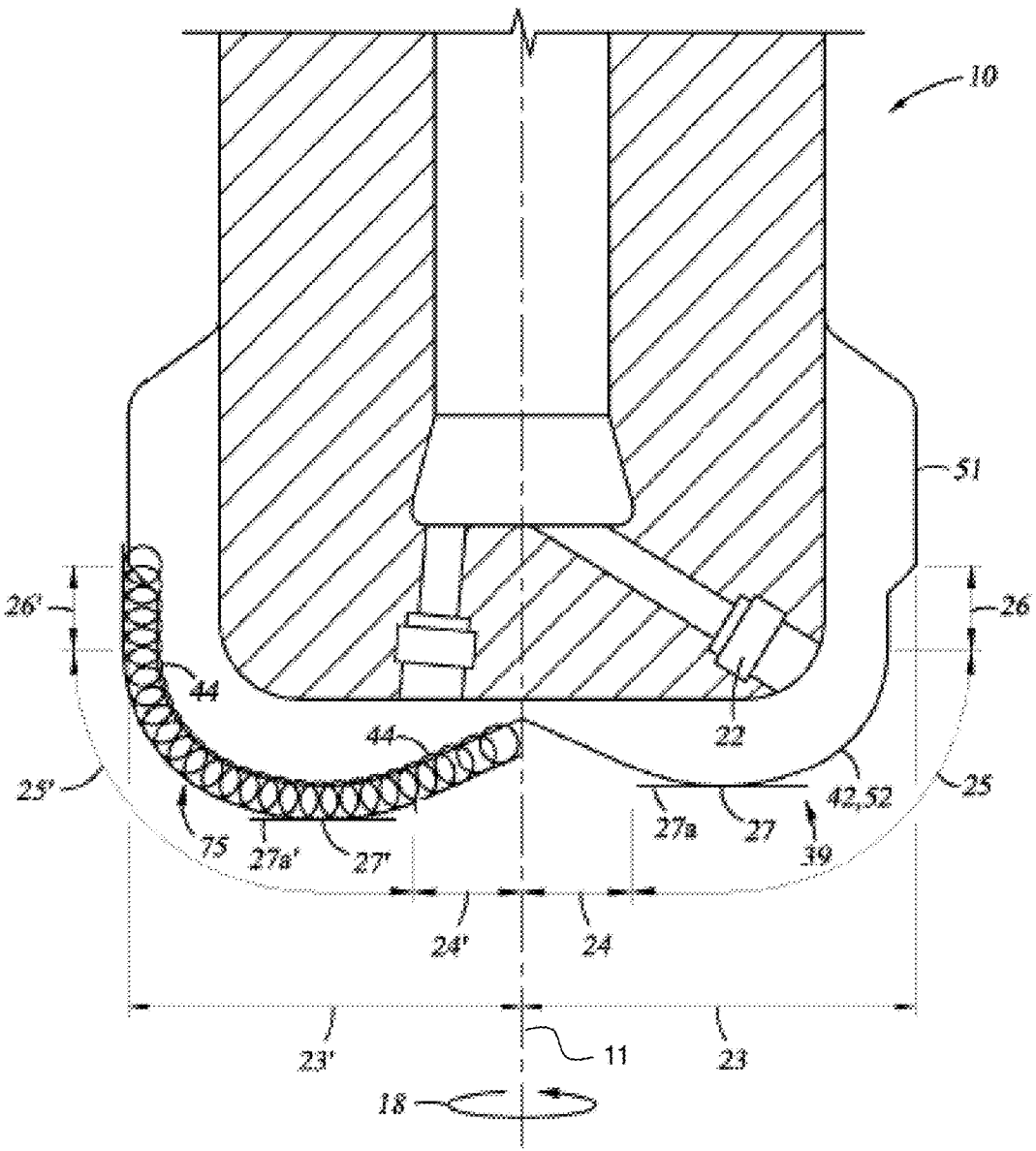
FIG. 2 is a cross-sectional view of a PDC drill bit.

Referring now to FIG. 2, a profile of PDC bit 10 is shown as it would appear with all blades (e.g., primary blades 31, 32, 33 and secondary blades 34, 35, 36) and cutting faces 44 of all cutting elements 40 rotated into a single rotated profile. In rotated profile view, blade tops 42, 52 of all blades 31-36 of PDC bit 10 form and define a combined or composite blade profile 39 that extends radially from bit axis 11 to outer radius 23 of PDC bit 10. Thus, as used herein, the phrase "composite blade profile" refers to the profile, extending from the bit axis to the outer radius of the bit, formed by the blade tops of all the blades of a bit rotated into a single rotated profile (i.e., in rotated profile view).

The composite blade profile 39 (most clearly shown in the right half of PDC bit 10 in FIG. 2) may generally be divided into three regions: cone region 24, shoulder region 25, and gage region 26. The cone region 24 includes the radially innermost region of the PDC bit 10 and composite blade profile 39 extending generally from the bit axis 11 to the shoulder region 25. As shown in FIG. 2, the cone region 24 is generally concave. Adjacent to the cone region 24 is the shoulder (or the upturned curve) region 25. In most conventional fixed cutter bits, the shoulder region 25 is generally convex. Moving radially outward, adjacent the shoulder region 25 is the gage region 26 which extends parallel to the bit axis 11 at the outer radial periphery of the composite blade profile 39. Thus, the composite blade profile 39 of the PDC bit 10 includes one concave region—cone region 24, and one convex region—shoulder region 25.

The axially lowermost point of the convex shoulder region 25 and the composite blade profile 39 defines a blade profile nose 27. At the blade profile nose 27, the slope of a tangent line **27*a* to the convex shoulder region 25 and the composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits, the composite blade profile includes a convex shoulder region (e.g., convex shoulder region 25), and a blade profile nose (e.g., nose 27). As shown in FIGS. 1 and 2, cutting elements 40 are arranged in rows along blades 31-36 and are positioned along the bit face 20 in the cone region 24, the shoulder region 25 and the gage region 26 of the composite blade profile 39. In particular, cutting elements 40 are mounted on the blades 31-36 in set radially-spaced positions relative to the central axis 11 of the PDC bit 10**.

Figure 3:
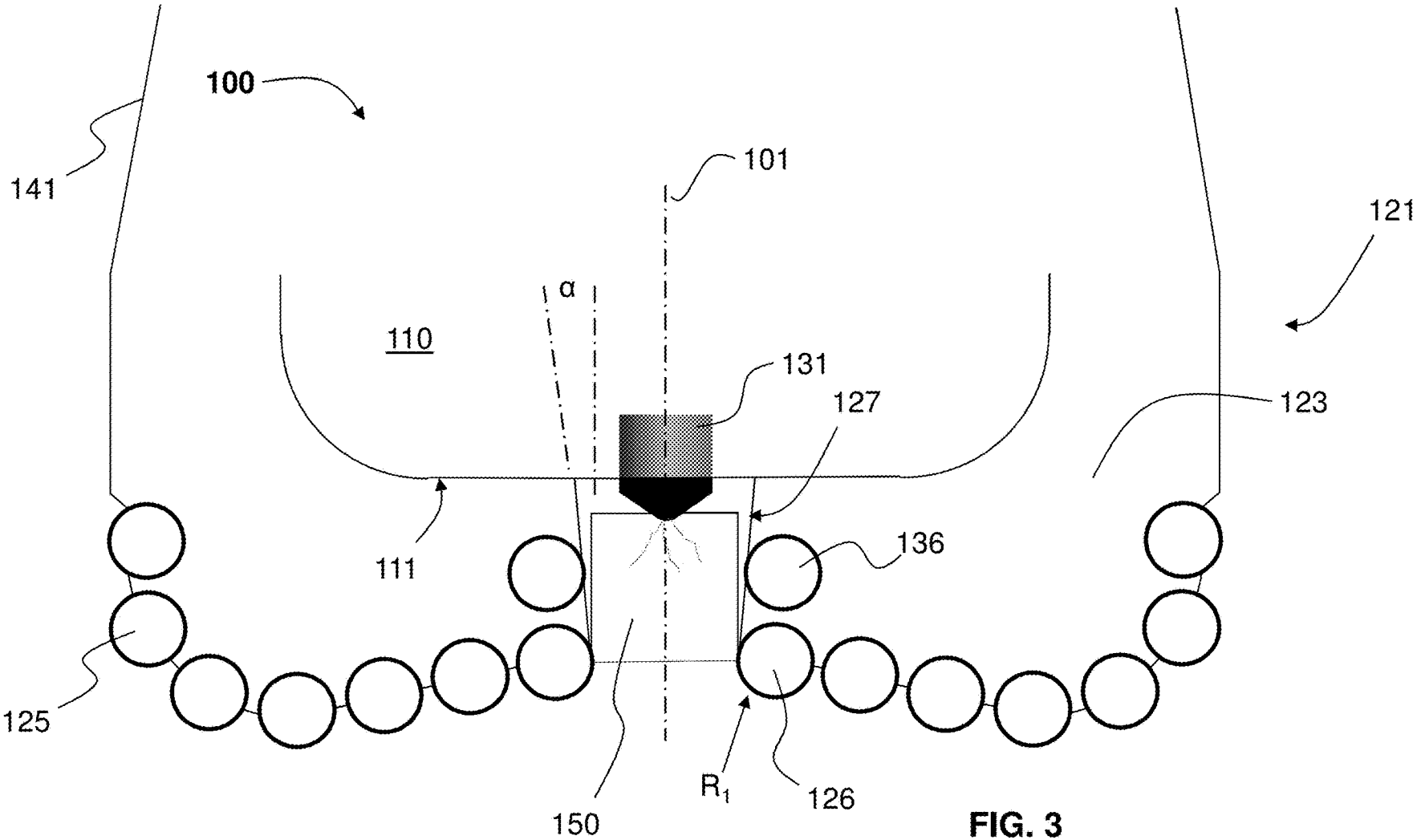
FIG. 3 shows a cutting profile according to embodiments of the present disclosure.

Referring to FIG. 3, a cutting profile according to one embodiment of the present disclosure is shown. As shown, the drill bit is a PDC bit 100 that includes a bit body 110 and a bit face 111. The bit face 111 is opposite the end used to secure the PDC bit 100 to a lower end of a drill string (not shown). The PDC bit 100 further includes a bit centerline 101 about which the PDC bit 100 rotates in a cutting direction. According to one or more embodiments of the present disclosure, the bit face 111 extends through the bit centerline 101 and smoothly transitions into and between flow courses (not shown).

When the PDC bit 100 is secured to the drill string, rotating the drill string causes the PDC bit 100 to rotate and penetrate and cut through a subterranean formation using a plurality of cutting elements 125, which are described in further detail below. As the PDC bit 100 penetrates and cuts through the subterranean formation, a wellbore is formed.

As shown in FIG. 3, the bit face 111 of the PDC bit 100 supports a plurality of blades 121 formed on the bit body 110. As shown, the plurality of blades 121 extend radially along bit face 111 and then axially along a portion of the periphery of the PDC bit 100. According to one or more embodiments of the present disclosure, one of the plurality of blades is a coring blade 123, which is described in further detail below. The plurality of blades 121 are separated by a plurality of flow courses (not shown), which enable drilling fluid to flow between and both clean and cool plurality of blades 121 during drilling.

As further shown in FIG. 3, each of the plurality of blades 121 includes a plurality of cutting elements 125 disposed thereon. As shown, a plurality of cutting elements 125 are arranged adjacent to one another in a radially extending row proximal the leading edge of each of the plurality of blades 121. The plurality of cutting elements 125 may have a substantially planar cutting face in order to achieve a shearing cutting action while drilling a formation. In other embodiments, any one of the plurality of cutting elements 125 may be rotatable cutting elements, such as those disclosed in U.S. Pat. No. 7,703,559, U.S. Patent Publication No. 2010/0219001, U.S. Patent Publication No. 2011/0297454, U.S. Patent Publication No. 2012/0273281, and U.S. Patent Publication No. 2012/0273280, all of which are assigned to the present assignee and are herein incorporated by reference in their entirety. In other embodiments, any one of the plurality of cutting elements 125 may be non-planar cutting elements, including conical cutting elements, such as those described in U.S. Patent Publication No. 2012/0234610, U.S. Patent Publication No. 2012/0205163, and U.S. Patent Publication No. 2013/0020134, all of which are assigned to the present assignee and are herein incorporated by reference in their entirety. Non-planar cutting elements are also described in further detail below.

According to one or more embodiments of the present disclosure, the PDC bit 100 includes a non-planar (e.g., conical) insert 131 embedded in the bit body 110 on or close to the bit centerline 101. As described in further detail below, the conical insert 131 works with the coring blade 123 to cause a core sample fragment 150 to break away from the formation during drilling.

As further shown in FIG. 3, one of the plurality of cutting elements 125 is a first cutter (or first cutting element) 126 on the coring blade 123, which is the radially most interior cutting element (i.e., the cutting element (other than the insert 131) closest to the bit centerline). According to one or more embodiments of the present disclosure, the first cutter 126 is disposed on the coring blade 123 at a first radial position R1 from the bit centerline 101. The cutting element 125 located closest to bit centerline 101, i.e., at the first radial position R1, is the first cutter 126. The first cutter 126 cuts a core sample 150 because a region of the cutting edge of first cutter 126 is exposed to the central region of bit 100 between the blades 121 (in the region surrounding the bit centerline), to cut the formation into a core sample 150 having a radius of R1.

In accordance with one or more embodiments of the present disclosure, the first radial position R1 is located at some distance away from the bit centerline 101 to allow for the formation of core sample fragment 150. According to one or more embodiments of the present disclosure, the first radial position R1 may be distanced from the bit centerline 101 at a distance in a range of 0.05 times the diameter of the PDC bit 100 to 0.25 times the diameter of the PDC bit 100. As understood by one of ordinary skill in the art, the first radial position R1 may be located at other distances away from bit centerline 101, depending on the desired size of the core sample fragment, without departing from the scope of the present disclosure.

As further shown in FIG. 3, according to one or more embodiments of the present disclosure, the coring blade 123 may include a continuously angled radially interior surface 127. The continuously angled surface 127 extends axially above the blade top and axially below bit face 111, extending from the bit face 111 to the first cutter 126 at the first radial position R1 from the bit centerline 101. According to one or more embodiments of the present disclosure, the bit face 111, the continuously angled surface 127, and the coring blade 123 are integrally formed.

In accordance with one or more embodiments of the present disclosure, the continuously angled surface 127 may be oriented such that the continuously angled surface 127 is sloped from the first cutter 126 at a radially outwardly opening angle $\alpha$ ranging from 0° to 20° (e.g., 0° to 15°, 0° to 10°, or 0° to 6°) with respect to a line parallel to the bit centerline 101. In other words, the continuously angled surface 127 slopes upwardly and outwardly as it extends from the first cutter 126 at the first radial position R1 to the bit face 111. At least a portion of the coring blade 123 is radially outward from a most radially interior cutting part of the first cutter 126. The slope of the continuously angled surface 127, angle $\alpha$, allows for the formation and extraction of core sample fragment 150 when the PDC bit 100 is tilted, for example, during directional drilling. For example, when the continuously angled surface 127 is oriented such that the continuously angled surface 127 slopes upwardly and outwardly from the first cutter 126 at the first radial position R1 to the bit face 111 at an angle $\alpha$ from the bit centerline 101, the PDC bit 100 may tilt up to an angle $\alpha$ from vertical, to maintain the formation and extraction of the core sample fragment 150 at the desired core sample fragment length.

In some embodiments, the continuously angled surface 127 may slope upwardly and outwardly from first cutter 126 at the first radial position R1 to the bit face 111 such that the angle $\alpha$ may have a lower limit of any of at least 0.5°, 1°, 2°, or 3° with respect to a line parallel to bit centerline 101, and an upper limit of any of 2°, 3°, 4°, 5°, 6°, 7°, 8°, 9°, or 10° with respect to a line parallel to the bit centerline 101, where any lower limit can be used in combination with any upper limit. The present disclosure is not limited, however, and may include other angles, depending on the build rate angles used in the steerable device (not shown) for directional drilling. For example, in one or more embodiments the angle $\alpha$ may be at least that of the build angle selected for the directional drilling job. Embodiments including more than one coring blade 123 may be arranged such that each continuously angled surface 127 of coring blade 123 has the same angle $\alpha$, or arranged such that each continuously angled surface 127 of coring blade 123 has a different angle $\alpha$ from each other.

FIG. 3 also shows a conical insert 131 on or proximate bit centerline 101. As used herein, "proximate" with respect to the bit centerline 101 means either on the bit centerline 101 or between the bit centerline 101 and the coring blade 123. Conical insert refers to a cutting element having a generally conical cutting end (including either a right cone or oblique cone) that terminates in a rounded apex. According to one or more embodiments of the present disclosure, the apex of the conical insert 131 may have curvature between side surfaces of the conical insert 131 and the apex. The structure of the conical insert 131 may allow cutting of a resulting fragment 150 by compressive fracture or gouging. According to one or more embodiments of the present disclosure, the conical insert 131 is embedded in the bit body 110 such that an apex of conical insert 131 is positioned axially above first cutter 126 (as shown in FIG. 3). That is, the tip of the conical insert 131 may be closer to the bit face than the first cutter 126. As understood by one of ordinary skill in the art, in addition to the height of the coring blade 123, the length of the conical insert 131 protruding from the bit face 111 also helps determine the length of the resulting core sample fragment 150.

As shown, according to one or more embodiments of the present disclosure, the conical insert 131 may be a rigid cutting element configured in the general shape of a cone. However, the shape of the conical insert 131 is not intended to be limiting, and the conical insert 131 may be configured in a different shape than a cone. As understood by one of ordinary skill in the art, according to one or more embodiments of the present disclosure, the conical insert 131 may in fact be replaced with any insert have any shape that acts to break up the core sample fragment 150 that comes in contact therewith, including other cutting elements having non-planar cutting ends, as described below.

According to one or more embodiments of the present disclosure, the conical insert 131 may be formed as an integral element of the bit body 110, or as a non-integral insert made of a polycrystalline superabrasive material. According to one or more embodiments of the present disclosure, the conical insert 131 is a non-integral insert that includes a substrate (such as a cemented tungsten carbide substrate) that interfaces with a diamond layer made of a polycrystalline superabrasive material, which may include, e.g., polycrystalline diamond, polycrystalline cubic boron nitride, or thermally stable polycrystalline diamond. According to one or more embodiments of the present disclosure, a diamond layer forms a conical diamond working surface of the conical insert 131, and the substrate forms a base of the conical insert 131. Without departing from the scope of the present disclosure, additional shapes, structures, compositions, and dimensions of conical insert 131 may be employed, such as those described in U.S. Patent Pub. No. 2013/0020134, which is herein incorporated by reference in its entirety.

According to one or more embodiments of the present disclosure, the conical insert 131 embedded proximate to the bit centerline 101 exerts a central load on the end of the core sample fragment 150 that is closest to the apex of the conical insert 131. The central load exerted by the conical insert 131 causes the core sample fragment 150 to fracture or crack. As a result of this central load and because the conical insert 131 is disposed on or proximate to the bit centerline 101, the core sample fragment 150 may break into two halves, which may or may not be substantially equal in length and width.

After the core sample fragment 150 is broken away from formation in accordance with one or more embodiments of the present disclosure, bit hydraulics help the newly extracted core sample fragment 150 to be relayed and/or directed toward flow courses (not shown) between the plurality of blades 121 for exit of PDC bit 100. According to one or more embodiments of the present disclosure, from a flow course, core sample fragment 150 is transported to the surface of the formation via an annulus between the wellbore and the drill string.

Figure 4:
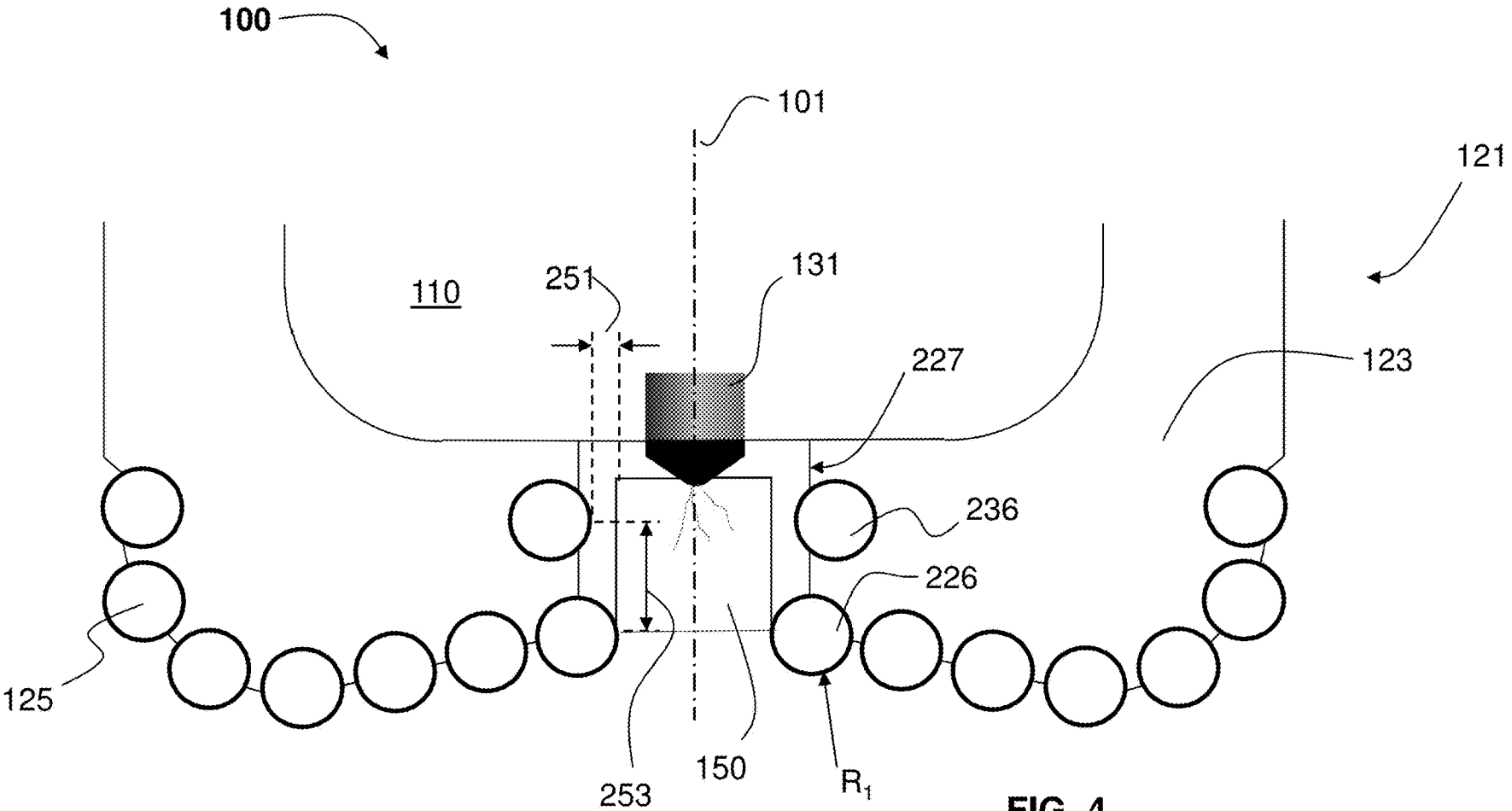
FIG. 4 shows a cutting profile according to embodiments of the present disclosure.
Figure 5:
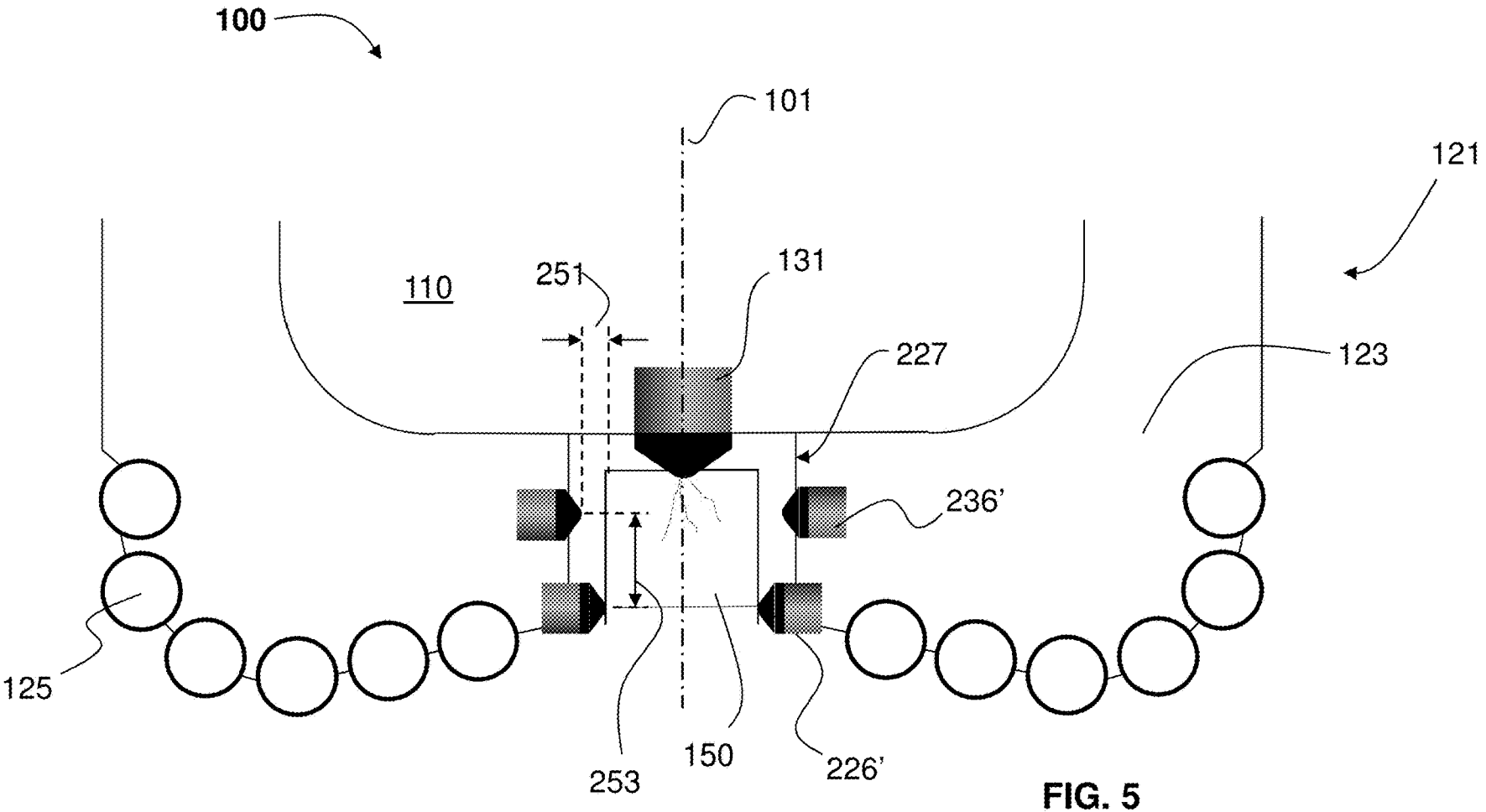
FIG. 5 shows a cutting profile according to embodiments of the present disclosure.
Figure 6:
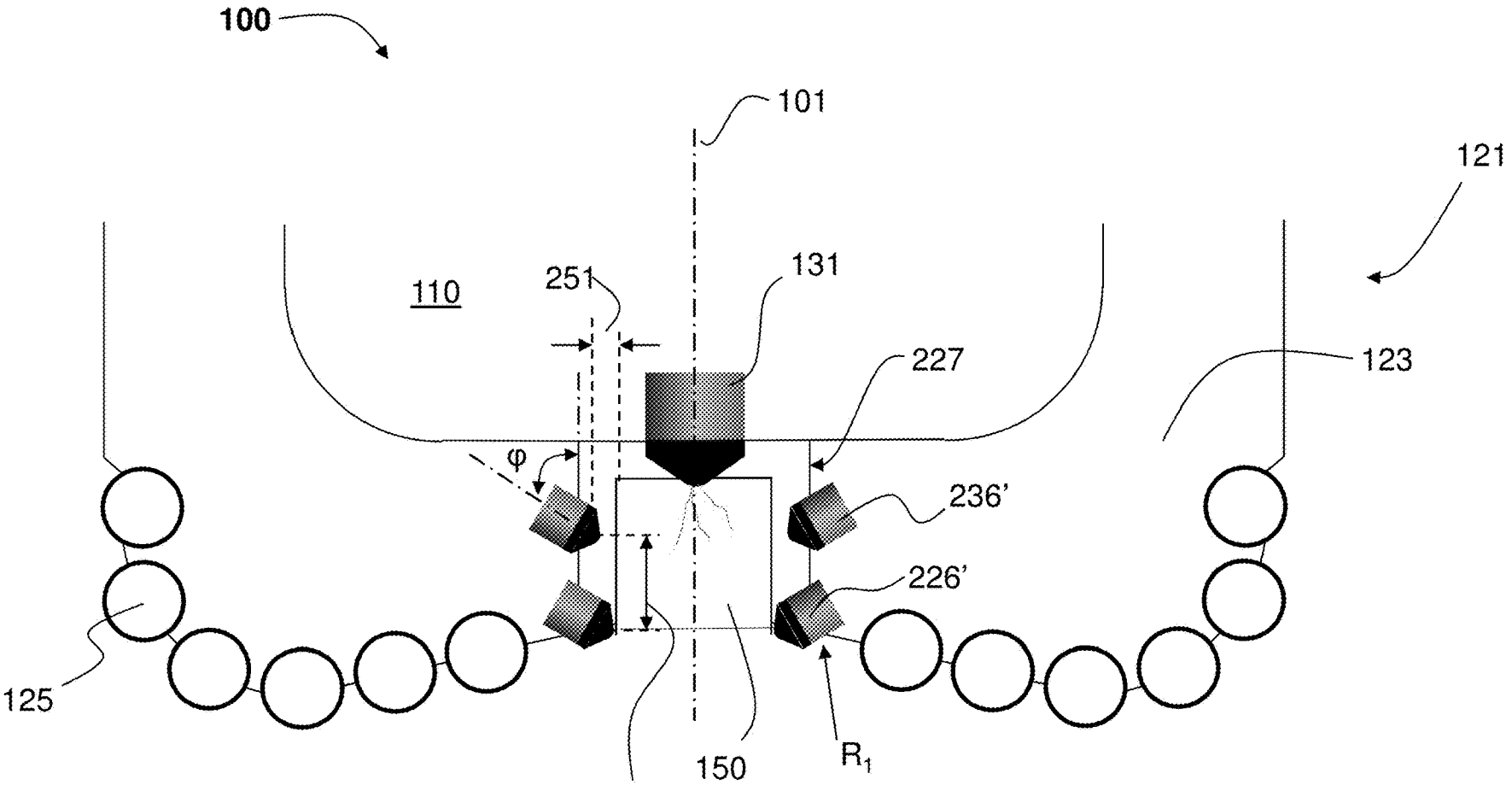
FIG. 6 shows a cutting profile according to embodiments of the present disclosure.

Referring now to FIGS. 4-6, a cutting profile according to one or more embodiments of the present disclosure is shown. As shown, one of the plurality of cutting elements 125 is a first cutter (or first cutting element) 226 disposed on the coring blade 123. According to one or more embodiments of the present disclosure, the first cutter 226 is disposed on the coring blade 123 at a first radial position R1 (at the most radially interior position) from the bit centerline 101. The first radial position R1 is determined by rotating all of the cutting elements 125 into a single rotated view to produce a cutting profile. The cutting element 125 located closest to the bit centerline 101, i.e., at the first radial position R1, is the first cutter 226.

As further shown in FIGS. 4-6, according to one or more embodiments of the present disclosure, the coring blade 123 may include a substantially vertical radially interior surface 227 (the surface facing the bit centerline 101). The substantially vertical surface 227 is axially above the blade top and axially below bit face 111. Specifically, the substantially vertical surface 227 extends from the bit face 111 to the first cutter 126 at the first radial position R1 from the bit centerline 101. According to one or more embodiments of the present disclosure, the bit face 111, the substantially vertical surface 227, and coring blade 123 are integrally formed. In such embodiments, the substantially vertical surface 227 may extend from the bit face 111 to the first cutter 226 at the first radial position R1 such that the axial length of the substantially vertical surface 227 may have a lower limit of any of at least 0.05, 0.1, 0.15, or 0.2 times the diameter of the bit, and an upper limit of any of 0.1, 0.15, 0.2, or 0.25 times the diameter of the bit, where any lower limit can be used in combination with any upper limit.

In accordance with one or more embodiments of the present disclosure, one of the plurality of cutting elements 125 is a core trimming cutter (or interior cutting element) 236 disposed on the substantially vertical surface 227. In such embodiments, as shown in FIGS. 4 and 5, the interior cutting element 236 may be affixed to the substantially vertical surface 227 such that there is a radial offset 251 between the cutting edge of the first cutter 226 and the cutting edge of the core trimming cutter 236. That is, the core trimming cutter 236 is affixed to the coring blade 123 on the substantially vertical surface 227 at a greater radial distance from the bit centerline than the cutter 226 at the first radial position R1. According to embodiments of the present disclosure, the core trimming cutter 236 may have an exposure above the radially interior surface 227 ranging between 0 and 0.25 inch, or between 0.05 and 0.2 inch, or 0.125 inch. As shown in FIG. 4, the radially interior portion of the cutting edge of the core trimming cutter 236 is positioned radially outwardly from the radially interior portion of the cutting edge of first cutter 226 a distance equal to the radial offset 251. The radial offset 251 may help allow the formation and extraction of the core sample fragment 150 when the PDC bit 100 is tilted, for example, during directional drilling.

In a particular embodiment, the first cutter 226 and the core trimming cutter 236 may be arranged such that the radial offset 251 may have a lower limit of any of at least 0.02, 0.03, 0.04, or 0.05 inch (or at least 0.51, 0.76, 1.02, or 1.27 mm), and an upper limit of any of 0.03, 0.04, 0.05, 0.06, 0.1, or 0.5 inch (or of any of 0.76, 1.02, 1.27, 1.52, 2.54, or 12.7 mm), where any lower limit can be used in combination with any upper limit. Embodiments including more than one coring blade 123 may be arranged such that the core trimming cutters 236 on each coring blade 123 has the same radial offset 251, or arranged such that the core trimming cutters 236 on each coring blade 123 has a different radial offset 251 from each other. Further, the radial offset of the substantially vertical surface 227 may be the same or different on each coring blade 123. In such embodiments, there also exists an axial offset 253 between the first cutter 226 and core trimming cutter 236. The axial offset 253 may be equal to the radius of the first cutter 226 plus the radius of the core trimming cutter 236 plus a spacing ranging from 0.05 inch to 1 inch (e.g., 0.1 to 0.8 inch or 0.4 to 0.6 inch).

Still referring to FIGS. 4-6, a conical insert 131 may be on or proximate to the bit centerline 101. The structure of the conical insert 131 may allow cutting of a resulting core fragment 150 by compressive fracture or gouging. According to one or more embodiments of the present disclosure, the conical insert 131 is embedded in bit body 110 such that an apex of conical insert 131 is positioned axially above of the cutting edge of core trimming cutter 236. As understood by one of ordinary skill in the art, in addition to the height of coring blade 123, the length of conical insert 131 protruding from bit face 111 also helps determine the length of the resulting core sample fragment 150. In such embodiments, an apex of the conical insert 131 may be positioned axially above the most radially interior portion of the cutting edge of core trimming cutter between 0 and 1 inch, between 0.3 and 0.7 inch, or at least 0.3 inch.

As shown in FIG. 4, first cutter 226 and core trimming cutter 236 may have a substantially planar cutting face according to one or more embodiments of the present disclosure. In one or more embodiments, the first cutter 226 and the core trimming cutter 236 may be rotatable cutting elements. As shown in FIG. 5, the first cutter 226' and the core trimming cutter 236' may be conical or other non-planar cutting elements according to one or more embodiments of the present disclosure. Further, while not illustrated, it is also within the scope of the present disclosure that the first cutter may have a planar cutting face and the core trimming cutter may have a non-planar cutting end, or vice versa (where the first cutter may have a non-planar cutting end and the core trimming cutter may have a planar cutting face). Additionally, while not also illustrated, it is within the scope of the present disclosure that different sized cutting elements may be used between the first cutter and core trimming cutter. For example, in one embodiment, the core trimming cutter may be relatively smaller than the first cutter (e.g., it may have a smaller diameter than the first cutter).

Referring to FIG. 6, the first cutter 226' and the core trimming cutter 236' may be conical (or other non-planar) cutting elements and oriented such that at least one of the first cutter 226 and the core trimming cutter 236' point inwardly and downwardly towards the subterranean formation to be drilled (as compared to the inward orientation illustrated in FIG. 5). In such embodiments, the first cutter 226' and the interior cutter 236' are oriented such that there is an angle φ formed between a centerline through the apex of the conical cutting element and a line parallel to the bit centerline 101. In various embodiments, the angle φ may range from greater than 0° to 90°. In some embodiments, the angle φ may range from a lower limit of any of greater than 0°, 2°, 5°, 10°, 15°, 20°, or 30° to an upper limit of any of 15°, 20°, 25°, 30°, 35°, 40°, or 45°, where any lower limit may be used in combination with any upper limit.

Referring back to FIG. 3, in some embodiments, the plurality of cutting elements 125 may include interior core trimming cutting element 136 affixed to the coring blade 123 at or adjacent to the continuously angled surface 127. In various embodiments, the core trimming cutting element 136 may have a planar cutting face or be a rotatable cutting element, or according to some embodiments, the core trimming cutting element 136 may be a conical (or other non-planar) cutting element. In such embodiments, at least the first cutter 126 and the core trimming cutter 136 may be oriented at a particular rake orientation (i.e., vertical or lateral orientation) on the coring blade 123. Generally, back rake orientation may refer to the angle formed between the cutting element central axis and a line normal to the formation being cut, while side rake orientation may refer to the angle formed between the cutting element central axis and a line parallel with the centerline of the cutting tool on which the cutting element is disposed.

Figure 10:
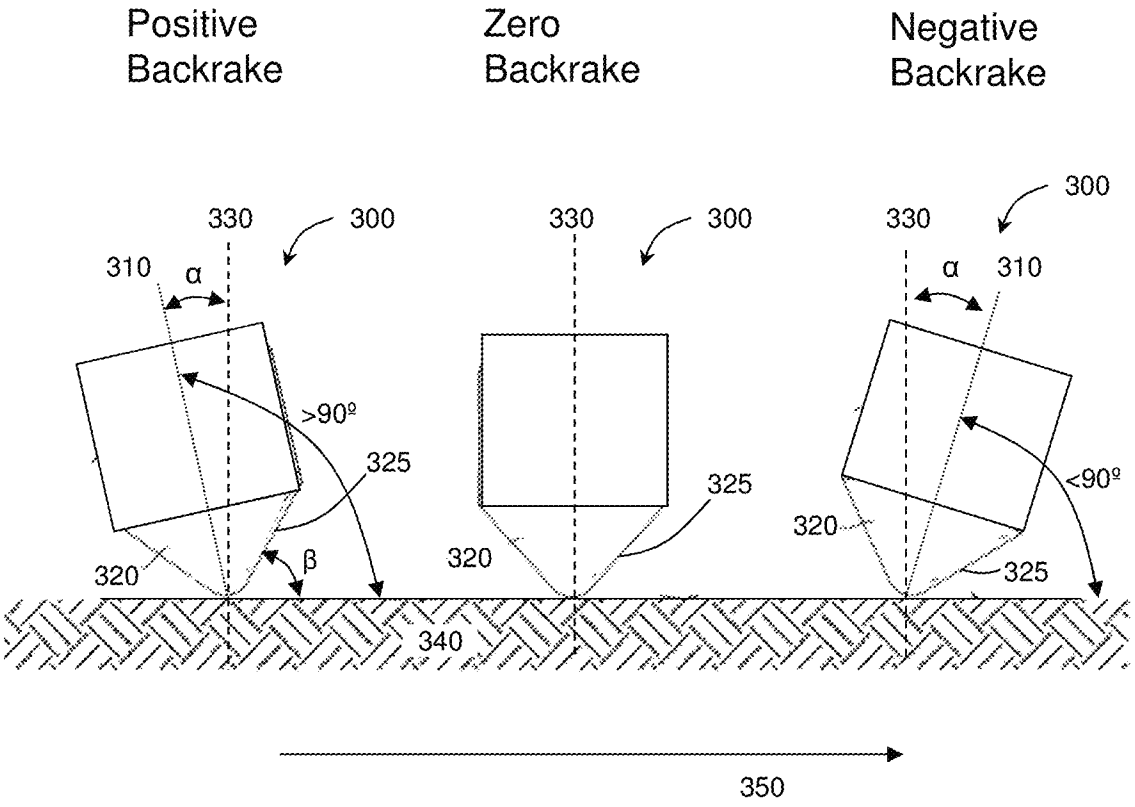
FIGS. 10-12 show back rake orientations of cutting elements according to embodiments of the present disclosure.

When considering the orientation of cutting elements having non-planar cutting ends, in addition to the vertical or lateral orientation of the cutting element body, the geometry of the non-planar cutting end also affects how and the angle at which the non-planar cutting element strikes the formation. Specifically, in addition to the back rake affecting the aggressiveness of the cutting end-formation interaction, the cutting end geometry (specifically, the apex angle and radius of curvature) affect the aggressiveness that the non-planar cutting element attacks the formation. In the context of a non-planar cutting element, as shown in FIG. 10, back rake may be defined as the angle α formed between the axis of the non-planar cutting element 300 (specifically, the axis 310 of the non-planar cutting end 320) and a line 330 that is normal to the formation material 340 being cut. As shown in FIG. 10, with a non-planar cutting element 300 having zero back rake, the axis 310 of the non-planar cutting element 300 is substantially perpendicular or normal to the formation material 340. A non-planar cutting element 300 having negative back rake angle α has an axis 310 that engages the formation material 340 at an angle that is less than 90° as measured from the formation material 340. Similarly, a non-planar cutting element 300 having a positive back rake angle α has an axis 310 that engages the formation material at an angle that is greater than 90° when measured from the formation material 340 and towards the direction 350 of rotation of the cutting tool on which the cutting element is disposed. In a particular embodiment, the back rake angle of a non-planar cutting element may be positive. In some embodiments, the back rake of non-planar cutting elements may range from 0° to 90°, from 0° to 35°, from 0° to 20°, from 0° to 10°, or from greater than or equal to 5°.

In addition to the orientation of the axis with respect to the formation, the aggressiveness of non-planar cutting elements may also be dependent on the apex angle or specifically, the angle between the formation and the leading portion of the non-planar cutting element. In some embodiments, a leading line of a non-planar cutting surface may be determined to be the firstmost points at each axial point along the side surface of the non-planar cutting end surface as the bit rotates. Said in another way, a cross-section may be taken of a non-planar cutting element along a plane in the direction 350 of the rotation of the cutting tool, as shown in FIG. 10. The leading line 325 of the non-planar cutting element 300 in such plane may be considered in relation to the formation 340. The strike angle of a non-planar cutting element 300 is defined to be the angle β formed between the leading line 325 of the non-planar cutting element 300 and the formation 350 being cut. The strike angle will vary depending on the back rake and the shape and angle of the leading line from the apex, and thus, the strike angle of the non-planar cutting element may be calculated to be the back rake angle less one-half of the angle of the leading line (i.e., $\beta=(0.5*\text{leading line angle})+\alpha$). In some embodiments, β may range from about 5° to 100° or from about 20° to 65°.

Figure 11:
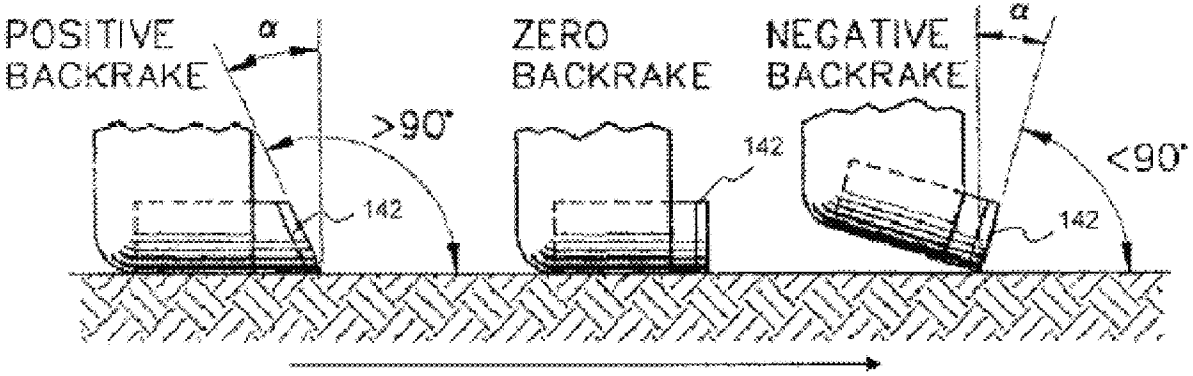

Referring to FIG. 11, the back rake of a cutting element having a planar cutting face may be defined as the angle α formed between the cutting face of the cutter 142 and a line that is normal to the formation material being cut. As shown in FIG. 11, with a conventional shear cutter 142 having zero back rake, the cutting face is substantially perpendicular or normal to the formation material. A cutter 142 having negative back rake angle α has a cutting face that engages the bottom hole at an angle that is less than 90° as measured from the formation material. Similarly, a cutter 142 having a positive back rake angle α has a cutting face that engages the formation material at an angle that is greater than 90°.

Figure 12:
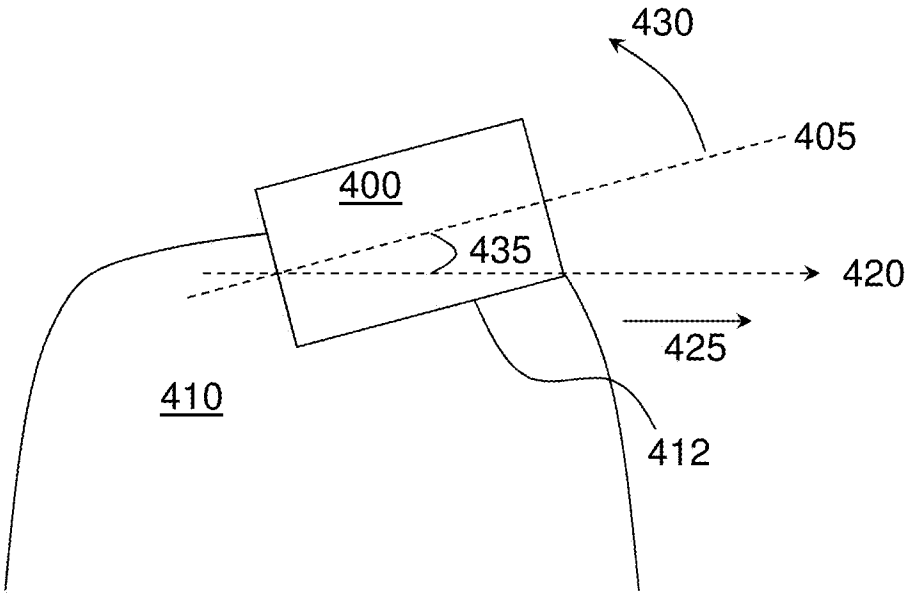

Cutting elements that cut formation material at the core sidewall or at both the bottom hole and the core sidewall may have a back rake angle measured with respect to the surface on which the cutting element is disposed and/or with respect to the direction of rotation of the cutting tool on which the cutting element is disposed. For example, in some embodiments, a back rake may refer to a direction of rotation of the cutting element along a plane intersecting the central axis of the cutting element and normal to the surface on which the cutting element is disposed, such that a back rake refers to a rotational direction exposing a relatively larger portion of the cutting end of the cutting element (negative back rake) or exposing a relatively larger portion of a base end (opposite the cutting end) of the cutting element (positive back rake). In other words, a back rake angle may refer to the rotation of the cutting end of a cutting element away from the surface on which it is disposed. FIG. 12 shows an example of a back rake 430 direction of rotation for a cutting element 400 disposed in a pocket 412 of a cutting tool blade 410. A back rake angle 435 may be measured between the central axis 405 of the cutting element and a line 420 extending at least partially through the cutting element 400 and in the direction of the cutting tool rotation 425. According to some embodiments, a core trimming cutter (e.g., the core trimming cutter 136 in FIG. 3) may be oriented with a back rake of 3° to 30°, or have a lower limit of any of 3°, 5°, 8°, or 10°, and an upper limit of any of 10°, 15°, 20°, 25°, or 30°.

Figure 13:
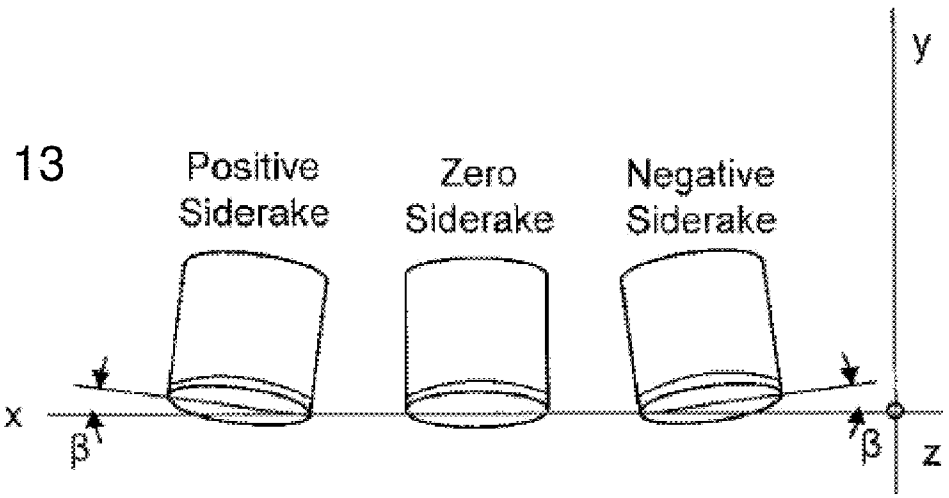
FIG. 13 shows a side rake orientation of cutting elements according to embodiments of the present disclosure.

Further, cutting elements of the present disclosure may be disposed on a cutting tool blade at a side rake, where the side rake may be defined as the angle between the cutting face and a radial plane of the cutting tool (x-z plane), as illustrated in FIG. 13. When viewing a cutting element disposed on a blade (from a perspective of looking at the outermost surface of the blade on which the cutting element is disposed), a negative side rake angle β results from counterclockwise rotation of the cutter on the blade surface, and a positive side rake angle β results from clockwise rotation of the cutter on the blade. Cutting elements positioned to cut a core (e.g., core trimming cutting elements) may have a side rake angle measured between the axis of the cutting element and a line parallel with the cutting tool centerline (e.g., angle φ shown in FIG. 6), where cutting elements positioned at a negative side rake have a cutting face rotated towards the interior of the tool body (e.g., towards a connection end of the tool) and cutting elements positioned at a positive side rake have a cutting face rotated away from the interior of the tool body (e.g., towards the cutting end of the tool). According to embodiments of the present disclosure, cutting elements may have a negative side rake ranging from 0° to 15°. Conical and other non-planar cutting element may have side rake angles that are defined similarly, as shown in U.S. Patent Publication No. 2012/0234610, the entire disclosure of which is incorporated by reference.

As discussed, the PDC bit 100 may tilt at an angle α from vertical, for example, during directional drilling. Referring to FIG. 3, the continuously angled surface 127 is oriented such that the continuously angled surface 127 slopes upwardly and outwardly from the first cutter 126 to the bit face 111 at an angle α from the bit centerline 101. Referring to FIGS. 4-6, the first cutter 226, 226' and the interior cutter 236, 236' may be arranged such that there is radial offset 251. In any of the embodiments, the continuously angled surface 127 and/or the axial offset 251 allows the PDC bit 100 to maintain the formation and extraction of the core sample fragment 150 at the desired the core sample fragment length when the PDC bit 100 may be tilted from vertical. In such embodiments, the outer gage region of the PDC bit 100 may also be angled from the bit centerline 101 (e.g., the gage region may be an extended gage and in some embodiments, the gage region 141 may angle inward toward the bit centerline as shown in FIG. 3) to accommodate a bit tilt within the wellbore. In some embodiments, the gage may include a plurality of gage pads extending from the plurality of blades having an angled gage surface. Such angles may be less than 5°, for example; however, the angle selected may depend on the desired build rate angle of the rotatable steerable tool, for example. In such embodiments, the continuously angled surface 127 may have an angle that is greater than the angled surface of the outer gage region of the bit 100, though angled in the opposite direction. That is, the outer gage region of the bit may angle towards the pin end of the bit centerline, whereas the radially inner angled surface may angle away from the pin end of the bit centerline. Further, a plurality of cutting elements 125 in a gage region of the bit may include a back rake angle ranging from about 5° to about 35°. In such embodiments, the interior cutters 136, 236, 236' and/or first cutter 126, 226, 226' may include a back rake angle less than the back rake angle of the plurality of cutting elements 125 in the gage region of the PDC bit 100.

Figure 7:
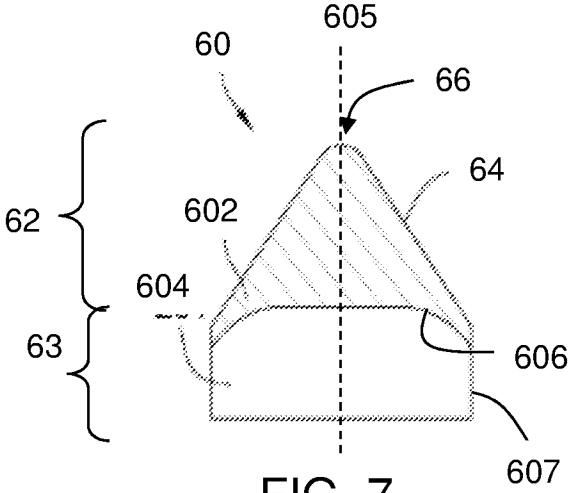

As mentioned above, several of the illustrated embodiments show the use of conical cutting elements. However, the present disclosure is not so limited. Rather, in each instance where a conical cutting element is described and/or illustrated, it is also intended that cutting element having other shaped non-planar cutting ends may be used. Non-planar cutting elements refers to those cutting elements having a non-planar cutting face, such as a generally pointed cutting end, e.g., having a cutting end terminating in an apex, which may include, for example, cutting elements having a conical cutting end (shown in FIG. 7) or a bullet cutting element (shown in FIG. 8), for example. As used herein, the term conical cutting elements refers to cutting elements having a generally conical cutting end 62 (including either right cones or oblique cones), i.e., a conical side wall 64 that terminates in an apex 66, which could be rounded as shown in FIG. 7 or could be flat (i.e., the apex could be cut off). Unlike geometric cones that terminate at a sharp point apex, conical cutting elements may also possess an apex having curvature between the side surfaces and the apex. Further, in one or more embodiments, a bullet cutting element 70 may be used. The term bullet cutting element refers to a cutting element having, instead of a generally conical side surface, a generally convex side surface 78 terminated in an apex 76, which could be rounded or flat (i.e., the apex could be cut off). In one or more embodiments, when the apex 76 is rounded, it may have a substantially smaller radius of curvature than the convex side surface 78. However, it is also intended that the non-planar cutting elements of the present disclosure may also include other non-planar cutting end shapes having an apex, including, for example, a concave side surface terminating in a rounded apex, shown in FIG. 9. In each of such embodiments, the non-planar cutting elements may have a smooth transition between the side surface and the rounded apex (i.e., the side surface or side wall tangentially joins the curvature of the apex), but in some embodiments, a non-smooth transition may be present (i.e., the tangent of the side surface intersects the tangent of the apex at a non-180° angle, such as for example ranging from about 120° to less than 180°).

The apex of a non-planar cutting element may have curvature, including a radius of curvature. In one or more embodiments, the radius of curvature may range from about 0.050 inch to 0.16 inch. One or more other embodiments may use a radius of curvature ranging from a lower limit of any of 0.05 inch, 0.06 inch, 0.075 inch, 0.085 inch, or 0.1 inch to an upper limit of any of 0.075 inch, 0.085 inch, 0.095 inch, 0.1 inch, 0.11 inch, 0.125 inch, or 0.16 inch, where any lower limit can be used with any upper limit. In some embodiments, the curvature may comprise a variable radius of curvature, a portion of a parabola, a portion of a hyperbola, a portion of a catenary, or a parametric spline. In one or more embodiments, the cone angle of the non-planar cutting element may range from 60° to 120°. However, the non-planar cutting element may be sharp or have a flat top.

Further, in one or more embodiments, the non-planar cutting elements may include any pointed or otherwise non-planar cutting end shape having an cutting end extending above a grip or base region, where the cutting end extends a height that is at least 0.25 times the diameter of the cutting element, or at least 0.3, 0.4, 0.5, 0.6, 0.7, or 0.8 times the diameter in one or more other embodiments. As used herein, a cutting end may include the side surface and rounded apex forming the non-planar working surface. According to some embodiments, a cutting end may be formed of an ultrahard material, such as diamond, diamond composite, polycrystalline diamond, thermally stable polycrystalline diamond (formed either by treatment of polycrystalline diamond formed from a metal catalyst such as cobalt or polycrystalline diamond formed with a metal having a lower coefficient of thermal expansion than cobalt), polycrystalline cubic boron nitride, or combinations of ultrahard material, which may be attached to or formed on a substrate forming the grip or base region.

Figure 8:
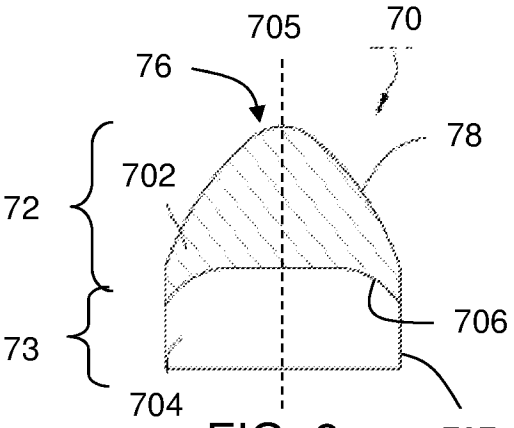
FIGS. 7-9 show various examples of non-planar cutting elements.
Figure 9:
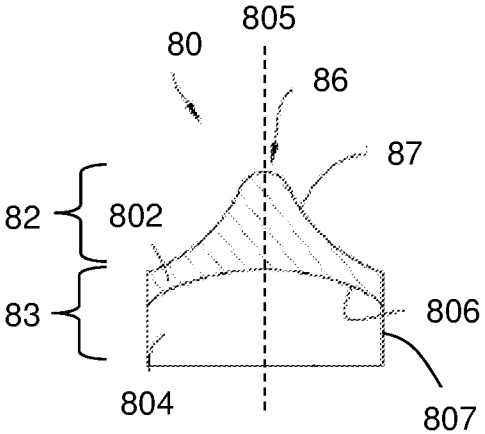

For example, as shown in FIGS. 7-9, non-planar cutting elements possess a diamond layer 602, 702, 802 on a substrate 604, 704, 804 (such as a cemented tungsten carbide substrate), where the diamond layer 602, 702, 802 forms a non-planar diamond working surface. Non-planar cutting elements may be formed in a process similar to that used in forming diamond enhanced inserts (used in roller cone bits) or by brazing components together.

The interface 606, 706, 806 between diamond layer 602, 702, 802 and substrate 604, 704, 804 may be non-planar or non-uniform, for example, to aid in reducing incidents of delamination of the diamond layer 602, 702, 802 from substrate 604, 704, 804 when in operation and to improve the strength and impact resistance of the element. The interface may include one or more convex or concave portions, as known in the art of non-planar interfaces. Additionally, use of some non-planar interfaces may allow for greater thickness in the diamond layer in the tip region of the layer. Further, it may be desirable to create the interface geometry such that the diamond layer is thickest at a zone that encompasses the primary contact zone between the diamond enhanced element and the formation. Additional shapes and interfaces that may be used for the diamond enhanced elements of the present disclosure include those described in U.S. Patent Publication No. 2008/0035380, the entirety of which is incorporated by reference. In some embodiments, non-planar cutting elements may have a planar interface between an ultra-hard material body forming the non-planar cutting end and a substrate. In one or more embodiments, the diamond layer 602, 702, 802 may have a thickness of 0.100 to 0.500 inch (2.54 to 12.7 mm) from the apex to the central region of the interface with the substrate, and in or more particular embodiments, such thickness may range from 0.125 to 0.275 inch (3.175 to 6.985 mm). However, other sizes and thicknesses may also be used.

As used herein, a non-planar cutting end of a non-planar cutting element refers to the pointed end of the non-planar cutting element and is defined by the non-planar working surface, while a grip region refers to the remaining region of the non-planar cutting element axially adjacent the non-planar cutting end. As shown in FIGS. 7-9, a non-planar cutting element 60, 70, 80 may include a non-planar cutting end 62, 72, 82 defined by the non-planar working surface (including the side surface 64, 78, 87 and apex 66, 76, 86) and a grip region 63, 73, 83. The non-planar cutting end 62, 72, 82 extends from the grip region 63, 73, 83 and is formed of a portion of diamond body 602, 702, 802. The grip region 63, 73, 83 may be substantially cylindrical and is formed from the substrate 604, 704, 804 and the remaining portion of the diamond body 602, 702, 802. Thus, in the embodiments shown, the diamond body forms both the non-planar cutting end and a portion of the grip region of the non-planar cutting element. However, in other embodiments, a grip region may be formed entirely of a substrate, and the non-planar cutting end formed entirely of a diamond body. In yet other embodiments, a grip region may be formed of a combination of materials, for example, one or more substrate materials such as transition metal carbides, one or more transition layers including varying ratios of carbide and diamond mixtures, or a combination of substrate material, one or more transition layers and a portion of the material also forming the non-planar cutting end.

Further, according to embodiments of the present disclosure, a non-planar cutting element may include a substantially cylindrical grip region and a pointed non-planar cutting end. In other embodiments, a non-planar cutting element may include a grip region with a non-cylindrical shape. For example, a grip region may have a curved base surface or a tapered base end, where the base surface and base end are opposite the cutting end of the cutting element. In some embodiments, a grip region may include the region of the non-planar cutting element defined by one or more outer side surfaces substantially parallel with a central longitudinal axis of the non-planar cutting element. For example, as shown in FIGS. 7-9, the grip regions 63, 73, 83 are defined by the outer side surface 607, 707, 807 of each non-planar cutting element 60, 70, 80 that is parallel with the central longitudinal axis 605, 705, 805 of each non-planar cutting element. The cross sectional shape of the grip region 63, 73, 83 along a plane perpendicular to the longitudinal axis 605, 705, 805 and defined by the outer side surface 607, 707, 807 may be circular, thereby forming a cylindrically shaped grip region 63, 73, 83. In other embodiments, a cross sectional shape of a grip region may be non-circular, e.g., elliptical or polygonal. It is intended that combinations of the types, geometry (including radius of curvature, cone angle, etc.) may be used between the first cutter and the core trimming cutter. For example, in one or more embodiments, it might be desirable to have a sharper first cutter (smaller radius of curvature and/or smaller cone angle) than the core trimming cutter, or vice versa.

Methods of obtaining core sample fragments from a subterranean formation during directional drilling may include coupling a drill bit, as described above, to a steerable tool at a lower end of a drill string. For example, the bit may have a threaded pin end capable of threadedly connecting to a steerable tool used for directional drilling. A drill bit may include a coring feature, for example, coring blades having an angled surface proximate the bit centerline and/or interior cutting elements having radial offset for extracting core samples during directional drilling. The drill string may be rotated to engage the drill bit with the subterranean formation, cutting and creating a wellbore. The steerable tool may introduce a non-vertical angle to the drill string and tilt the drill bit to drill the formation at a non-vertical direction, or directionally drill. As the drill bit rotates, the coring feature of the drill bit may be used to weaken a core sample fragment and cause the core sample fragment to break away from the formation after the core sample fragment reaches a length (e.g., reaches a set or predetermined length, e.g., the distance between where the first cutting element engages the formation and the apex of the insert 131, however, any suitable desired length may be used). Hydraulic forces from the bit and drilling fluid may direct the extracted core sample fragment toward flow courses between a plurality of blades in the drill bit. According to one or more embodiments of the present disclosure, from a flow course, a core sample fragment is transported to the surface of the formation via an annulus that is formed between the wellbore and the drill string.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

What is claimed is:

1. A drill bit comprising:

a bit body having a bit centerline and a bit face;

at least one cutting insert in the bit body proximate the bit centerline;

a plurality of blades extending radially along the bit face; and a plurality of cutting elements on the plurality of blades, the plurality of cutting elements including a first cutting element on one of the plurality of blades that is at a first radial position closest to the bit centerline, the one of the plurality of blades defining a radially interior surface that is tapered and which interfaces the bit face at a radial position farther from the bit centerline than the first radial position.

2. The drill bit of claim 1, the plurality of cutting elements including a second cutting element on the radially interior surface that is axially nearer the bit face than the first cutting element.

3. The drill bit of claim 1, the radially interior surface being continuously angled.

4. The drill bit of claim 3, the plurality of blades including:

a gage surface at a radially outermost region of the drill bit, at least one gage surface being angled toward the bit centerline.

5. The drill bit of claim 4, the continuously angled surface having an angle that is equal to or greater than the angle of the at least one gage surface.

6. The drill bit of claim 1, the first cutting element having a planar cutting face.

7. The drill bit of claim 1, the first cutting having a non-planar cutting face.

8. The drill bit of claim 1, the plurality of cutting elements including cutting elements having planar cutting faces and cutting elements having non-planar cutting faces.

9. A drill bit for breaking away cores ample fragments, comprising:

a bit body having a bit centerline and a bit face;

a plurality of blades extending along the bit face;

a plurality of cutting elements on the plurality of blades, the plurality of cutting elements comprising:

a first cutting element located on a first blade of the plurality of blades at a first radial position from the bit centerline, a trimming cutting element on an interior surface of the first blade, the trimming cutting element being axially nearer the bit face than the first cutting element and at a greater radial distance from the bit centerline than the first cutting element; and a cutting insert affixed to the bit body proximate the bit centerline.

10. The drill bit of claim 9, the interior surface being continuously angled outward from the first radial position toward the bit face.

11. The drill bit of claim 9, the interior surface being substantially vertical.

12. The drill bit of claim 9, radially interior portions of the first cutting element and the trimming cutting element being radially offset by an amount between 0.02 inch and 0.06 inch.

13. The drill bit of claim 9, the plurality of cutting elements having at least one of a substantially planar cutting face, a conical cutting face, or a rotatable cutting face.

14. The drill bit of claim 13, the first cutting element and the trimming cutting element each having a pointed cutting end terminating in an apex.

15. The drill bit of claim 14, the first cutting element and the trimming cutting element each pointing inwardly toward the bit centerline and downwardly away from the bit face.

16. The drill bit of claim 14, a cutting face of the cutting insert being at least 0.3 inch nearer the bit face than the apex of the trimming cutting element.

17. The drill bit of claim 14, the first cutting element and the trimming cutting element pointed in a direction that is perpendicular to the bit centerline.

18. The drill bit of claim 9, the plurality of cutting elements including gage cutting elements having a back rake angle greater than a back rake angle of the trimming cutting element.

* * * * *